US005580155A

United States Patent [19]

Hildebrand et al.

[11] Patent Number: 5,580,155

[45] Date of Patent: Dec. 3, 1996

[54] CABINET LIGHTING SYSTEM

[75] Inventors: Jeff Hildebrand; Kelly Copeland, both of 59 Brookview, Dana Point, Calif. 92629

[73] Assignees: Jeff Hildebrand; Kelly Copeland, both of Dana Point, Calif.

[21] Appl. No.: 333,761

[22] Filed: Nov. 3, 1994

[51] Int. Cl.[6] ..... A47B 97/00

[52] U.S. Cl. ..... 362/133; 362/155; 439/638; 439/655

[58] Field of Search ..... 437/676, 638, 437/655; 362/226, 133, 92, 94, 127, 145, 155, 234, 227

[56] References Cited

U.S. PATENT DOCUMENTS 4,872,095 10/1989 Dubak et al. ..... 362/155 X
5,032,957 7/1991 Canfield ..... 362/133
5,034,861 7/1991 Sklenak et al. ..... 362/133 X
5,287,252 2/1994 Caruso ..... 362/234 X
5,391,095 2/1995 Born ..... 439/638 X

*Primary Examiner*—Denise Gromada
*Assistant Examiner*—Thomas M. Sember

[57] ABSTRACT

A cabinet lighting apparatus including a plurality of lamps attached to an interior cabinet wall in proximity to a cabinet door, the lamps including an actuation device so that they are illuminated when the cabinet door is opened, and extinguished when the door is closed. The lamps are connected to a main power distribution box by a telephone wire, each end including a miniature telephone plug, one plugging into a receptacle on the lamp, and the other plugging into one of a plurality of receptacles on the distribution box. The distribution box includes a step-down transformer that transforms standard 110 VAC to a voltage below 50 VAC. The distribution box accepting a battery and further including an outlet line for plugging the box into an electrical outlet, and an adjustable switch to easily convert the apparatus between AC and DC current.

3 Claims, 4 Drawing Sheets

CABINET LIGHTING SYSTEM

FIELD OF THE INVENTION

This invention relates generally to automatic lighting units and more particularly to a lighting system easily installed in or more cabinets so that a light or lights are activated when the corresponding cabinet door is opened and deactivated when it is closed.

BACKGROUND OF THE INVENTION

Invention and use of automatic lighting systems are known to the public. Such systems can be employed in a variety of uses, such as automatic outdoor flood light systems. Typically, these automatic systems work in conjunction with a motion sensor or the like so as to turn on the light or lights when human or other presence is detected.

Unfortunately, the principles of automatic lighting have not been applied to cabinet lighting. This is likely because such lighting systems frequently require extensive electrical systems that must be installed by an electrician, and are therefore not feasible for such use, although there is an existing need for this type of application.

Generally, cabinet systems, particularly in kitchens and bathrooms, are built to maximize the available space in order to provide the most storage area possible. To accomplish this, cabinets are often constructed to be particularly deep or wide, especially in corner cabinet units. While such designs provide greater storage space, they often prohibit easy viewing of the shelves' contents. Thus, to obtain and remove a desired object often requires that many objects be moved around or removed so as to allow visual access to the shelves' contents. In addition, it is often desired to quickly remove something from a cabinet without turning on the overhead lights in that room.

To date there is no prior art designed to conveniently aid in viewing the contents of a cabinet, whether the limited visibility is due to poor room lighting, no lighting, or deep shelving units. While a great deal of this inaccessibility can be eliminated simply by shining a light into the cabinet to allow improved viewing of the contents, a flashlight or the like is not always readily available when searching for an object. Thus, there is a need for a lighting mechanism internally included within the cabinet so that it is always readily available when a cabinet is opened.

A can opener and night light appliance introduced by Joseph Moore in U.S. Pat. No. 4,979,308 is perhaps the only invention that has the capacity to immediately fulfill this needs. This invention comprises an under-the- cabinet kitchen appliance that functions as an automatic electric can opener and an automatic night light. The appliance includes a housing for the automatic electric can opener integral with a night light bulb housing. The electric circuit for the night light and the can opener are integrated and may include a light responsive device so that the light bulb is energized during periods of low room illumination and de-energized during periods of high room illumination. Obviously though, it is not practical to use multiple can-opening units to illuminate every shelf in every cabinet in a house. Rather, the can opener feature basically limits this device to kitchen use on a single cabinet.

Thus, there remains a need for a lighting system that is capable of instantly illuminating shelves when the cabinet door is opened, and can simply and easily be installed. The present invention fulfills these needs and provides further related advantages as described in the following summary.

SUMMARY OF THE INVENTION

The present invention is an automatic lighting system designed to immediately illuminate selected shelves when a cabinet door is opened, thereby providing visual access to the contents of the cabinet.

The invention consists of several small, self-contained lamp units that are placed on the side walls of selected shelves. Each lamp contains a serviceable lamp and a proximity switch that automatically activates the lamp when the cabinet door is opened. Therefore, it is an object of the invention to provide immediate lighting of the cabinet shelves whenever the cabinet door is opened and to immediately extinguish the lamps when the cabinet door is closed.

Each lamp is connected to a power supply with an extremely small gauge telephone line. The is line is so small that it can be run right through tiny cracks or holes already existing in older cabinets. Thus, it is an object of the invention to minimize cabinet damage during installation of the system.

One end of each line has a miniature telephone plug that is plugged into the lamp. The line is then run from the lamp to a main distribution box. The excess line can then be clipped, and secured with another telephone plug. The telephone plug is then inserted in a telephone receptacle in the distribution box. Thus it is an object of the invention to be extremely easy to install, requires no wire splicing or advanced electrical knowledge but rather a simple plug-in system that can be performed by the general public. It is another object of the invention to allow the system to be tailored to each individual cabinet design, as the line is easily cut to the desired length.

The distribution box includes a outlet cord that runs from the box to an outlet power source. Further included in the distribution box is a transformer that converts the 110 volt AC current from the outlet to 3 to 6 volts DC. Alternately, the lamps could be powered by a battery unit. It is an object of the invention to provide a lighting system that provides a low voltage so as to fulfill the lighting needs of each shelf while being safe enough to contact contents of the shelf without presenting any danger of fire or damage to the contents.

It is another object of the invention to be readily adaptable for a wide range of uses. The lamps may be employed to illuminate the contents of a deep closet that is not visibly accessible by mere overhead light, or they could be employed to light a single cabinet when a quick item is to be grabbed without necessitating the use of the overhead lighting of the room. Still further, the device can be implemented in bedroom settings, where it is desirable to remove clothes or other contents from cabinets without turning on overhead lights and waking others.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
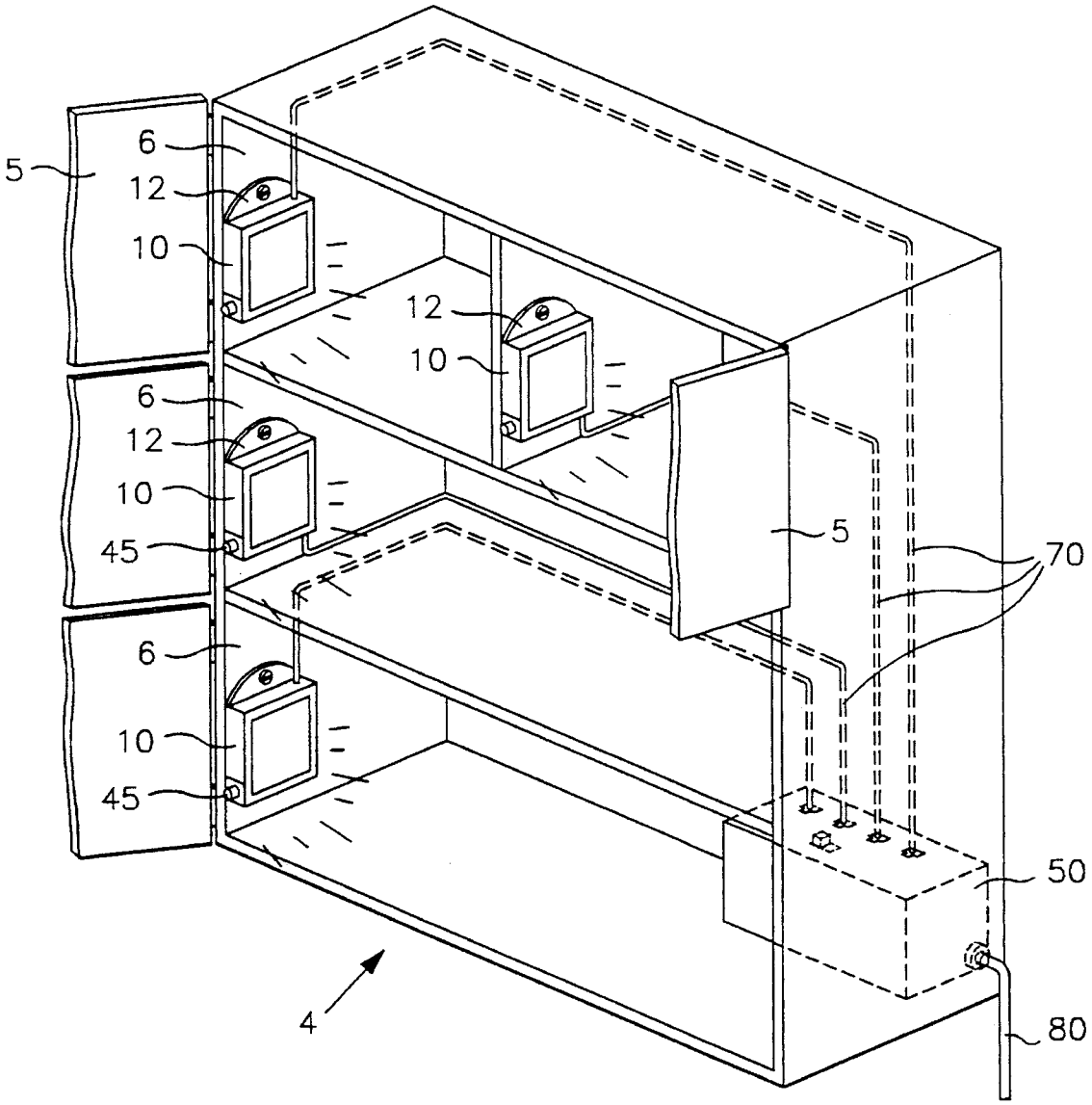
FIG. 1 is a perspective view of the present invention showing a series of cabinet lamps mounted within separate cabinet portions and additionally showing wires from the lamps to a control and distribution box of the invention.

FIG. 1 shows a cabinet lighting apparatus designed to illuminate a cabinet 4 with at least one door 5. Each door 5 is mounted on the cabinet 4 adjacent to an interior wall surface 6. The lighting apparatus includes a plurality of lamps 10 that can be placed in any combination on the interior wall surface 6 throughout the cabinet 4.

Figure 3:
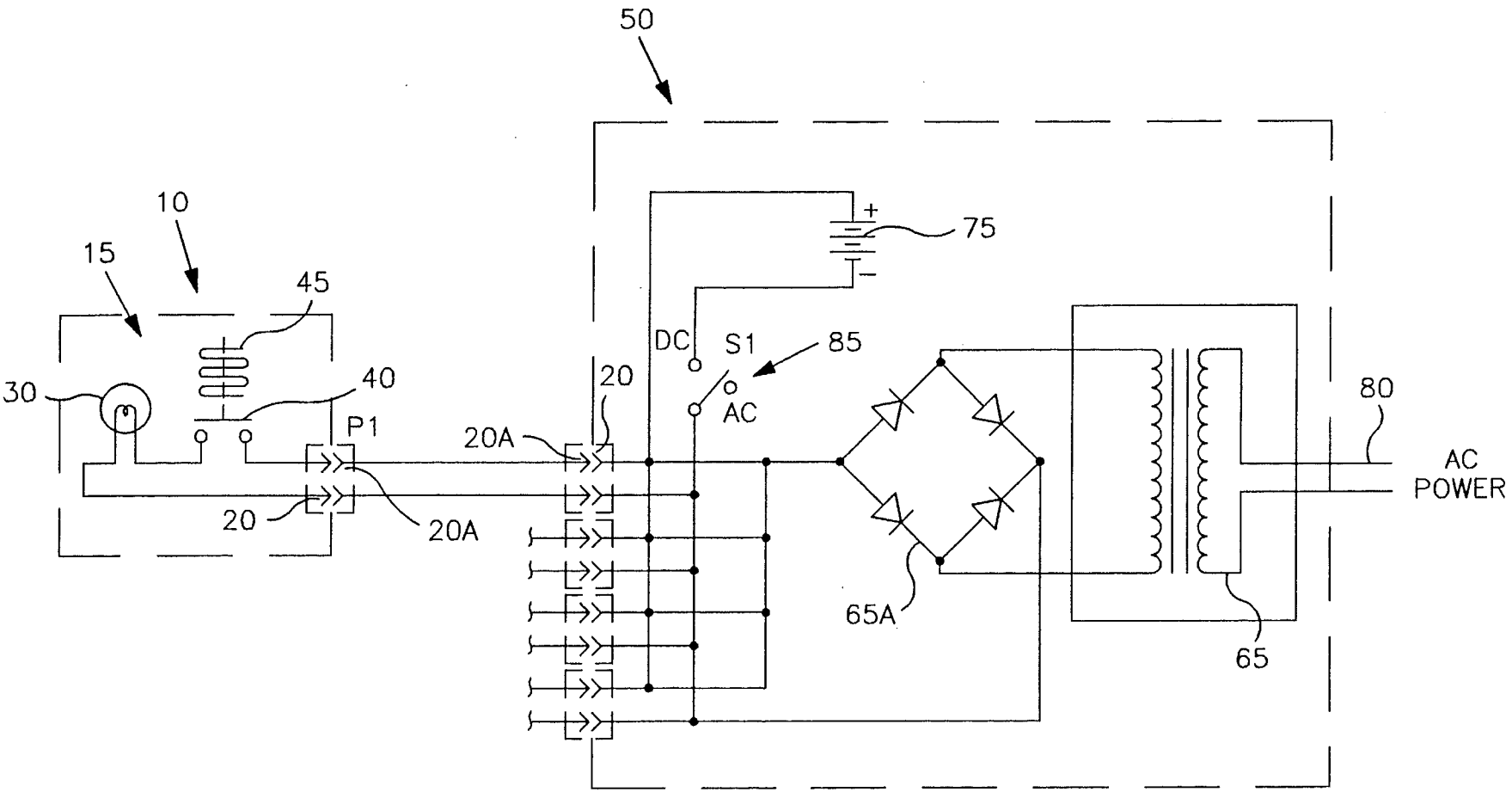
FIG. 3 is a schematic diagram of the present invention.

The lamps 10 are attached to the wall surface 6 in proximity to the door 5 by a mounting means 12, which may be a hardware fastener such as a screw or double-sided tape. As seen in FIG. 3, each of the lamps 10 provides a circuit 15 having a telephone line receptacle 20, an electrical powered illumination means 30, such as an electric light bulb, and a switch 40. The switch 40 has an actuation means 45 that interrelates with the proximal cabinet door 5 so that when the door 5 is closed, the actuation means 45 opens the circuit 15, thereby extinguishing the lamp 10. Likewise, when the door 5 is re-opened, the actuation means 45 closes the circuit 15, thereby illuminating the lamp 10. Preferably, the actuation means 45 is a spring actuated protruding rigid finger extending from the lamp forward to the corresponding door 5. The actuation means 45 could also be a magnetic actuated contactor, with the door 5 including a magnet positioned near the contactor when the door 5 is closed.

Figure 2:
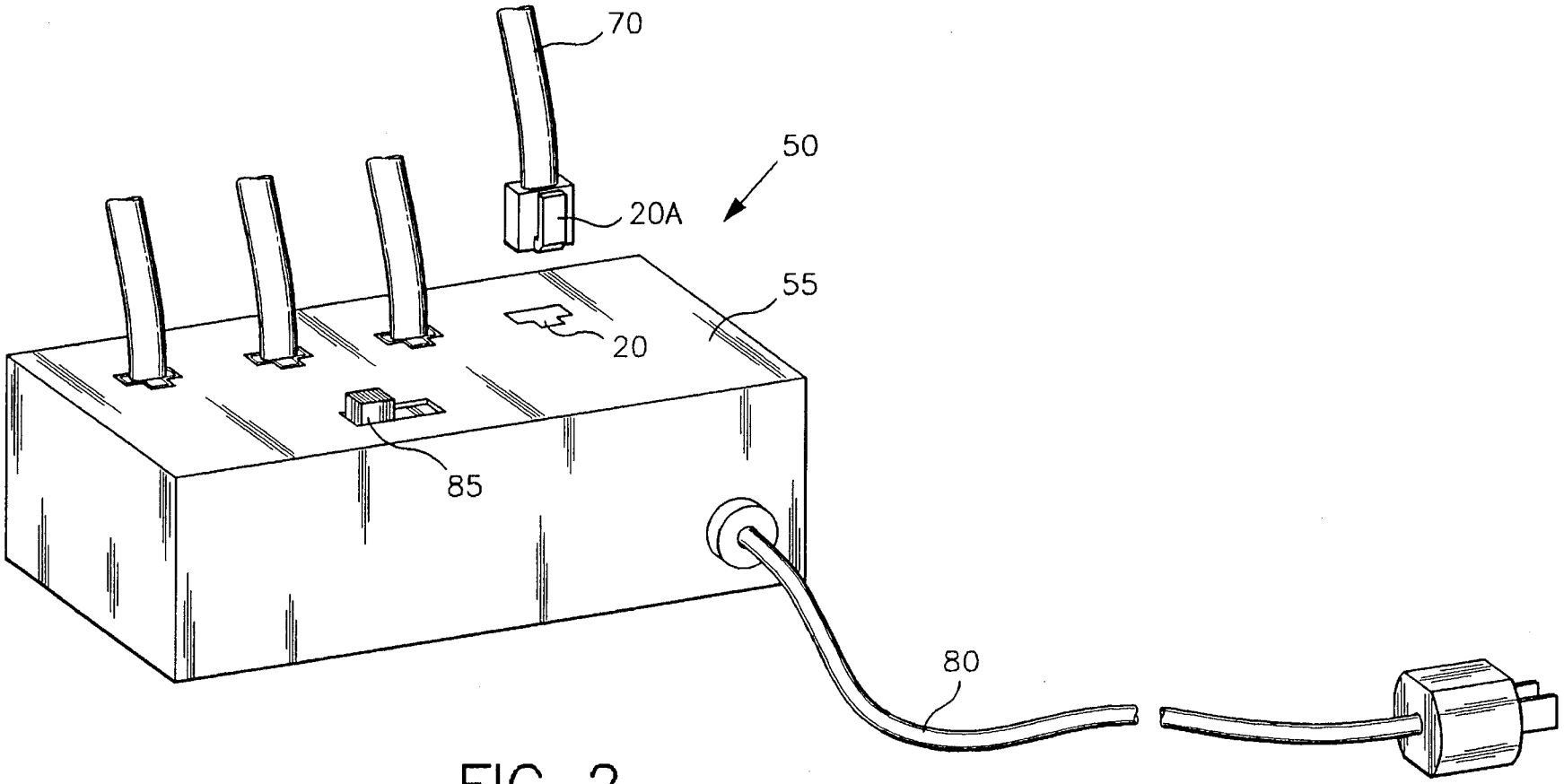
FIG. 2 is a perspective view of the control and distribution box of the invention showing telephone line type connectors on the ends of interconnection lines and how they connect to the control and distribution box.

In one embodiment, as seen in FIG. 2, a control and distribution box 50 has a box wall 55 that provides a series of miniature telephone receptacles 20 providing power to the lamps 10. The lamps 10 are connected to the distribution box 50 by a plurality of electrical lines 70. Each line 70 has a miniature telephone plug 20A at both ends, with one end plugging into the lamp's telephone line receptacle 20, and the plug 20A at the other end of the line 70 plugging into one of the receptacles 20 of the control and distribution box 50. There are several ways in which this connection can be made possible. As for example, once a line 70 is plugged into the telephone line receptacle 20, it is led to the control and distribution box 50 where it is cut to the appropriate length, the end secured to a telephone plug 20A and plugged into one of the receptacles 20.

Figure 2A:
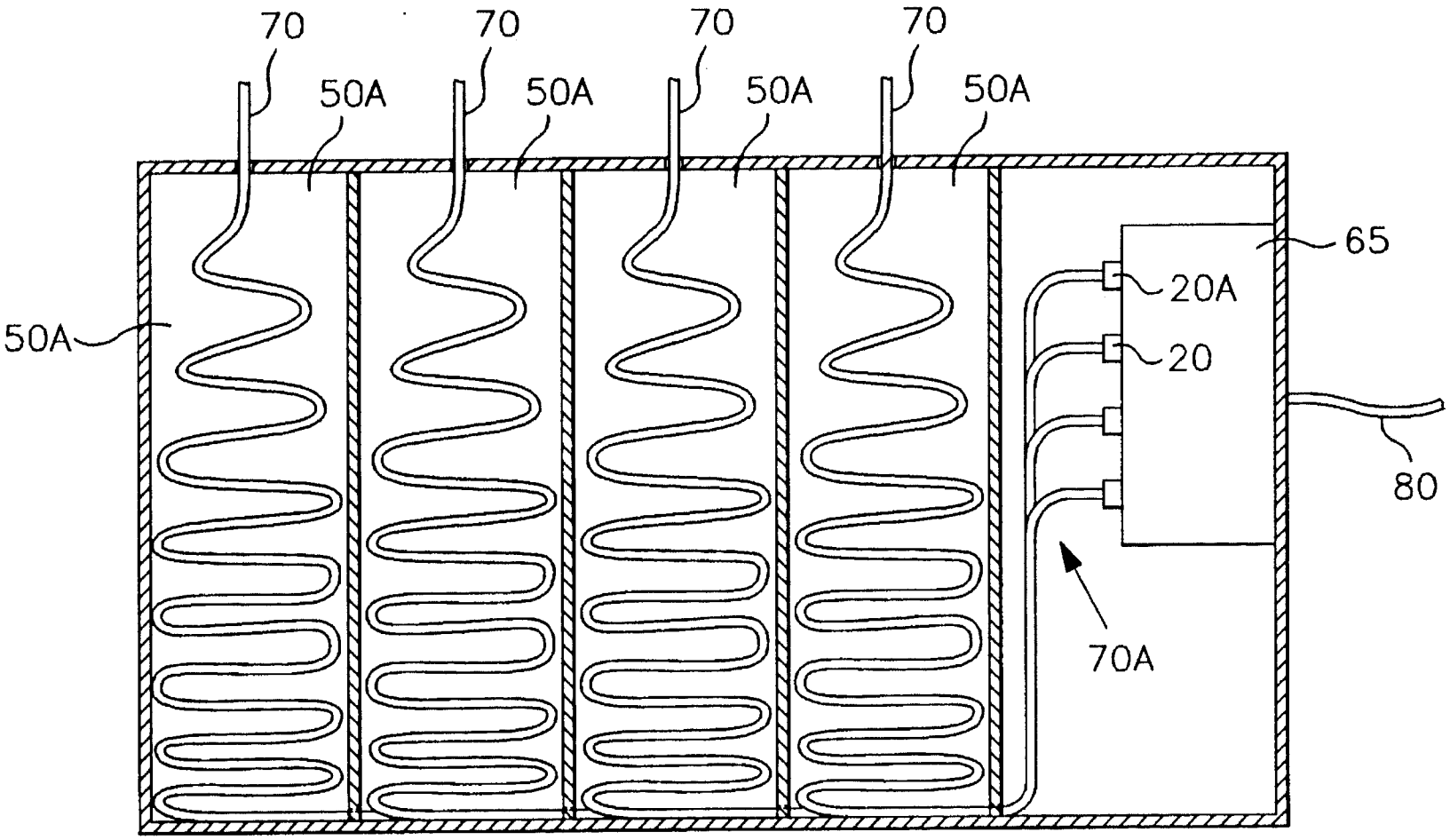
FIG. 2A is a schematic representation of the present invention, particularly showing the storage area for the telephone line.

In another embodiment, as shown in FIG. 2A the control and distribution box 50 is designed to provide a separate housing space 50A for each line 70. In each housing space, 50A a length of line 70 is provided, either wound around a spool in hose-type fashion, or neatly folded into the space. One end 70A of each line is plugged into a receptacle 20 in the distribution box 50, and the other end extends out of the control and distribution box 50. As such, each extending end can be pulled from the housing space to the lamp 10, the excess length of line 70 remaining in the housing space. This embodiment allows the lamps to be repositioned in the cabinet 4 without requiring modification to, or replacement of telephone line 70.

Once the lines 70 connect the control and distribution box 50 with the lamps 10, the control and distribution box supplies the lamp a low DC voltage. The box 50 includes both an AC outlet line 80 and a battery 75. Thus, if the box 50 is located near a standard AC electrical outlet, the outlet line 80 connects the two, and if the box 50 is not located near an outlet, the lighting apparatus can be battery powered. An external AC/DC switch 85 is provided on the box 50, so that the apparatus can be easily converted for either power source. The box 50 also includes a step-down transformer 65 and a rectifyer circuit 65A that transforms standard 110 VAC to a voltage in the range of 6 volts DC.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A cabinet lighting apparatus for providing illumination within portions of a cabinet having at least one door in proximity to one wall, the apparatus comprising:

a plurality of lamps, each of the lamps providing a circuit having a telephone line receptacle, an electrical powered illumination means and a switch, the switch having an actuation means interrelating with the at least one door such that with the at least one door in a first position closing the cabinet, the actuation means is caused to open the circuit for extinguishing the illumination means, each of the lamps further including means for mounting the lamp in proximity to the at least one door on the one wall;

a control and distribution box having a box wall providing a series of miniature telephone receptacles and a step-down transformer for transforming standard 110 VAC to a voltage below 50 VAC;

a plurality of electrical lines, each of the lines having a miniature telephone plug at both ends thereof, each one of the lines interconnecting the control and distribution box and a corresponding one of the lamps, the miniature telephone plugs engaging the miniature telephone receptacles of one of the lamps and one of the receptacles of the control and distribution box;

the control and distribution box including a plurality of storage spaces, each of the electrical lines coiled within one of the storage spaces, and extending from the storage spaces as necessary to reach each respective one of the lamps, with excess of the electrical lines remaining within the storage spaces.

2. The apparatus of claim 1 wherein the actuation means is a spring actuated protruding rigid finger extending from the lamp forward to the at least one door.

3. The apparatus of claim 1 wherein the actuation means is a magnetic actuated contactor, the at least one door including a magnet positioned for placement near the contactor when the door is closed.

* * * * *